US008397604B2

(12) United States Patent
Akkerman et al.

(10) Patent No.: US 8,397,604 B2
(45) Date of Patent: Mar. 19, 2013

(54) METHOD OF MANUFACTURING A CUTTING MEMBER OF A SHAVER

(75) Inventors: Hette Akkerman, Drachten (NL); Jan Van Driel, Drachten (NL); Willem Minkes, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 293 days.

(21) Appl. No.: 12/514,454

(22) PCT Filed: Nov. 12, 2007

(86) PCT No.: PCT/IB2007/054580

§ 371 (c)(1), (2), (4) Date: Dec. 8, 2009

(87) PCT Pub. No.: WO2008/059427

PCT Pub. Date: May 22, 2008

(65) Prior Publication Data

US 2010/0095531 A1 Apr. 22, 2010

(30) Foreign Application Priority Data

Nov. 15, 2006 (EP) ..... 06124107

(51) Int. Cl.
*B26B 19/14* (2006.01)
*B21K 11/00* (2006.01)

(52) U.S. Cl. ..... 76/115; 76/104.1; 30/436

(58) Field of Classification Search ..... 76/115, 76/104.1; 30/43.6, 346.51, 34.2, 43.4–43.92
See application file for complete search history.

(56) References Cited

U.S. PATENT DOCUMENTS

| | | | | |
|---|---|---|---|---|
| 2,195,163 | A | 3/1940 | Bott | |
| 5,823,082 | A | 10/1998 | Wilson et al. | |
| 5,983,756 | A * | 11/1999 | Orloff | 76/104.1 |
| 2003/0101706 | A1 * | 6/2003 | Kenny | 56/255 |
| 2005/0120567 | A1 * | 6/2005 | Okabe | 30/346.51 |

FOREIGN PATENT DOCUMENTS

| | | | |
|---|---|---|---|
| EP | 1537963 | A1 | 6/2005 |
| WO | 2006048799 | A1 | 5/2006 |

* cited by examiner

*Primary Examiner* — Ghassem Alie

(57) ABSTRACT

A method of manufacturing a cutting member (6) of a shaver (1) includes the steps of providing a plate-shaped carrier (10), cutting at least one cutting element (9*a*, 9*b*) free from the carrier except for a residual connection between a base (15, 23) of the cutting element and the carrier, and bending the cutting element relative to the carrier. The steps of cutting free and bending are performed simultaneously using a tool (11) having a combined punching and bending effect. By using such a tool, the action of cutting free is obtained by a tearing process which does not lead to a free space and a loss of material between the cutting element (9*a*, 9*b*) and the carrier (10). As a result, the strength of the carrier is not reduced by such a free space or loss of material.

8 Claims, 3 Drawing Sheets

METHOD OF MANUFACTURING A CUTTING MEMBER OF A SHAVER

FIELD OF THE INVENTION

The invention relates to a method of manufacturing a cutting member of a shaver, comprising the steps of providing a plate-shaped carrier, cutting at least one cutting element free from the carrier except for a residual connection between a base of the cutting element and the carrier, and bending the cutting element relative to the carrier.

BACKGROUND OF THE INVENTION

A method of manufacturing a cutting member of the kind mentioned in the opening paragraph is known from EP-A-1 537 963. The known method is in particular used to manufacture an internal cutting member of a cutting unit of an electric rotary shaver. The internal cutting member comprises an annular metal plate-shaped carrier with a number of regularly distributed cutting elements formed integrally with the carrier. Each cutting element is formed from the carrier by the successive steps of cutting free the cutting element from the carrier, except for a residual connection between a base of the cutting element and the carrier, and bending the cutting element upwardly relative to the carrier. The step of cutting free the cutting element is commonly performed by cutting a free space around the cutting element by means of a suitable cutting die. The successive step of bending the cutting element is commonly performed by bending the cutting element along a bending axis situated close to the base of the cutting element by means of a separate bending die.

A disadvantage of the known method is that the free space cut around the cutting element during the step of cutting free decreases the mechanical strength of the carrier. In order to obtain a required strength of the carrier the dimensions of the carrier should be increased to compensate the loss of material caused by the free space. Such an increase of the dimensions of the carrier is not always allowable, in particular in the case of shavers or cutting units thereof that have only a limited available space to accommodate the cutting member.

BRIEF SUMMARY OF THE INVENTION

It is an object of the present invention to provide a method of manufacturing a cutting member of the kind mentioned in the opening paragraph that does not have the disadvantage of the known method.

In order to achieve this object, a method of manufacturing a cutting member according to the invention is characterized in that the steps of cutting free and bending the cutting element are performed simultaneously using a tool having a combined punching and bending effect. By using a tool having a combined punching and bending effect, the cutting element is teared free and simultaneously bent out of the carrier. Accordingly the action of cutting free is obtained by a tearing process, which does not lead to a free space between the cutting element and the carrier. As a result, the strength of the carrier is not decreased by a free space between the cutting element and the carrier, so that the dimensions of the carrier need not be increased to remain a required strength of the carrier. An additional advantage of the method according to the invention is that, close to the residual connection between the base of the cutting element and the carrier, the side walls of the cutting element remain in contact with the carrier. As a result the carrier provides additional mechanical support to the cutting element via friction forces between the carrier and the portions of the side walls that are in contact with the carrier. This increases the stiffness and stability of the cutting elements.

It is noted that in this context the expression "a free space between the cutting element and the carrier" intends to indicate a free space or clearance oriented in a direction parallel to the carrier, so that the portion of the cutting element cut free from the carrier could be freely bent through the plane of the carrier without touching the carrier. In the cutting member manufactured according to the invention such a free space is not present, so that said portion of the cutting element would touch the carrier if it were bent through the plane of the carrier.

A particular embodiment of a method according to the invention is characterized in that the tool has a punching surface that, during the simultaneous steps of cutting free and bending the cutting element, has an angle of inclination relative to the carrier substantially corresponding with a desired bending angle of the cutting element relative to the carrier. In this particular embodiment the simultaneous steps of cutting free and bending take place in successive positions starting near an end portion of the cutting element and ending close to the base of the cutting element. This limits the punching force necessary to tear free and bend the cutting element.

A particular embodiment of a method according to the invention is characterized in that the simultaneous steps of cutting free and bending the cutting element are followed by at least one additional step of bending at least a portion of the cutting element into a final bent position. In this particular embodiment, after the cutting element has been cut free and bent into an initial bent position by the simultaneous steps of cutting free and bending, the cutting element or one or more particular portions thereof can be bent into any desired final bent position by the following at least one additional step of bending.

A further embodiment of a method according to the invention is characterized in that in the final bent position at least an end portion of the cutting element carrying a cutting edge is bent over an angle greater than 90° relative to the carrier. In this further embodiment the cutting edge of the cutting element is formed by an (upper) edge of the end portion of the cutting element that is first teared free from the carrier during the simultaneous steps of cutting free and bending. Said upper edge will be relatively free from burrs, as contrasted with the opposing (lower) edge of the end portion that is lastly teared free from the carrier during said simultaneous steps and that will have a considerable degree of burrs caused by the tearing process. In this way the cutting edge needs no or only limited after-processing.

A particular embodiment of a method according to the invention is characterized in that before the simultaneous steps of cutting free and bending the cutting element a free space is cut between the carrier and an end portion of the cutting element carrying a cutting edge. In this particular embodiment, by first cutting free said end portion using a suitable cutting die to cut a free space between said end portion and the carrier, only the remaining portion of the cutting element between said end portion and the base is teared free from the carrier. As a result, burrs at the location of the cutting edge are prevented, while the reduction of the strength of the carrier by the free space is limited to the area around the end portion of the cutting element.

The invention further relates to a cutting unit comprising an external cutting member and an internal cutting member movable relative to the external cutting member, wherein the internal cutting member is manufactured by a method according to the invention. The invention also relates to a shaving unit comprising at least one cutting unit according to the invention.

The invention also relates to a shaver comprising a shaving unit according to the invention.

BRIEF DESCRIPTION OF THE DRAWINGS

Particular embodiments of a method of manufacturing a cutting member according to the invention will be described in detail in the following with reference to the drawings, in which.

DETAILED DESCRIPTION OF THE INVENTION

Figure 1:
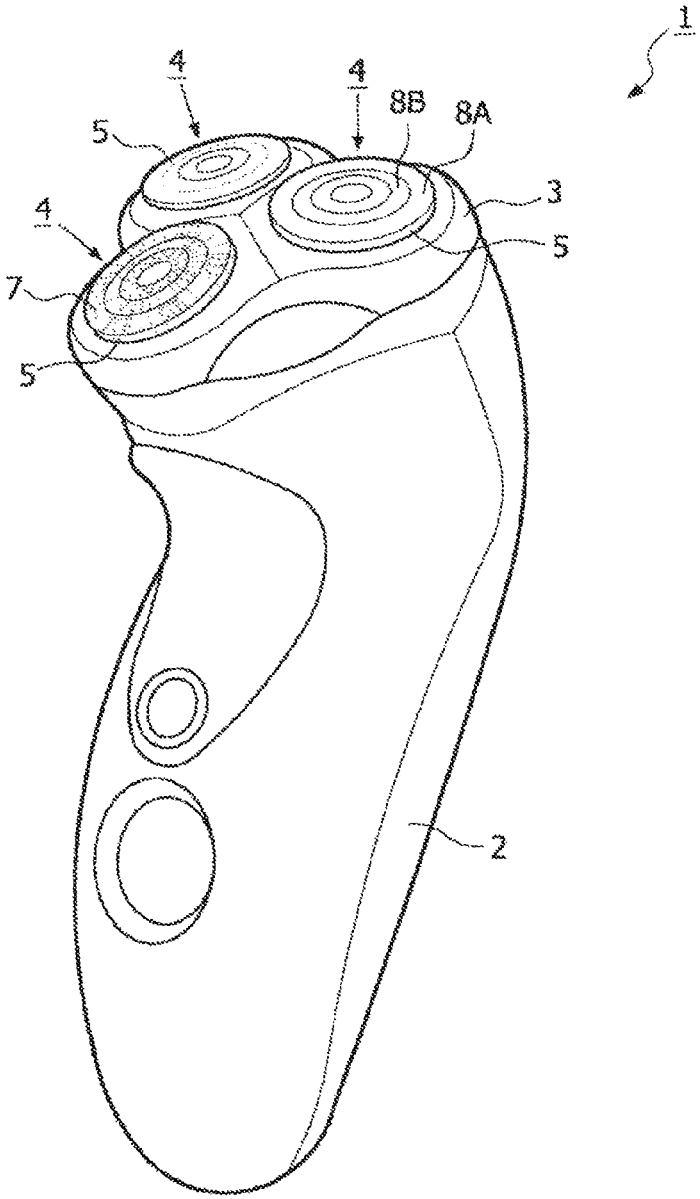
FIG. 1 shows a shaver according to the invention comprising a shaving unit according to the invention carrying three cutting units according to the invention.

FIG. 1 shows an example of a shaver 1 according to the invention. The shaver 1 is an electric rotary shaver and comprises a basic housing 2 on which a shaving unit 3 according to the invention is mounted. The shaving unit 3 carries three cutting units 4 according to the invention. Each cutting unit 4 comprises an external cutting member 5 and an internal cutting member 6, which is not visible in FIG. 1 but which is shown in detail in FIG. 2.

Each external cutting member 5 comprises hair-entry apertures 7 via which hairs can penetrate into the external cutting member 5. In the example shown the hair-entry apertures 7 are arranged in two concentric tracks 8*a*, 8*b*. In this example the internal cutting member 6 has two concentric circular arrays of regularly distributed cutting elements 9*a*, 9*b* for cooperation with said tracks 8*a*, 8*b*. The internal cutting member 6 is coupled to a drive system of the shaver 1 that is not visible in the figures. In operation the internal cutting member 6 is driven into a rotational motion relative to the external cutting member 5 in the direction of the arrow R in FIG. 2, so that hairs penetrating into the external cutting member 5 via the hair-entry apertures 7 are cut by a cutting co-operation between the cutting elements 9*a*, 9*b* and the tracks 8*a*, 8*b*.

Figure 3:
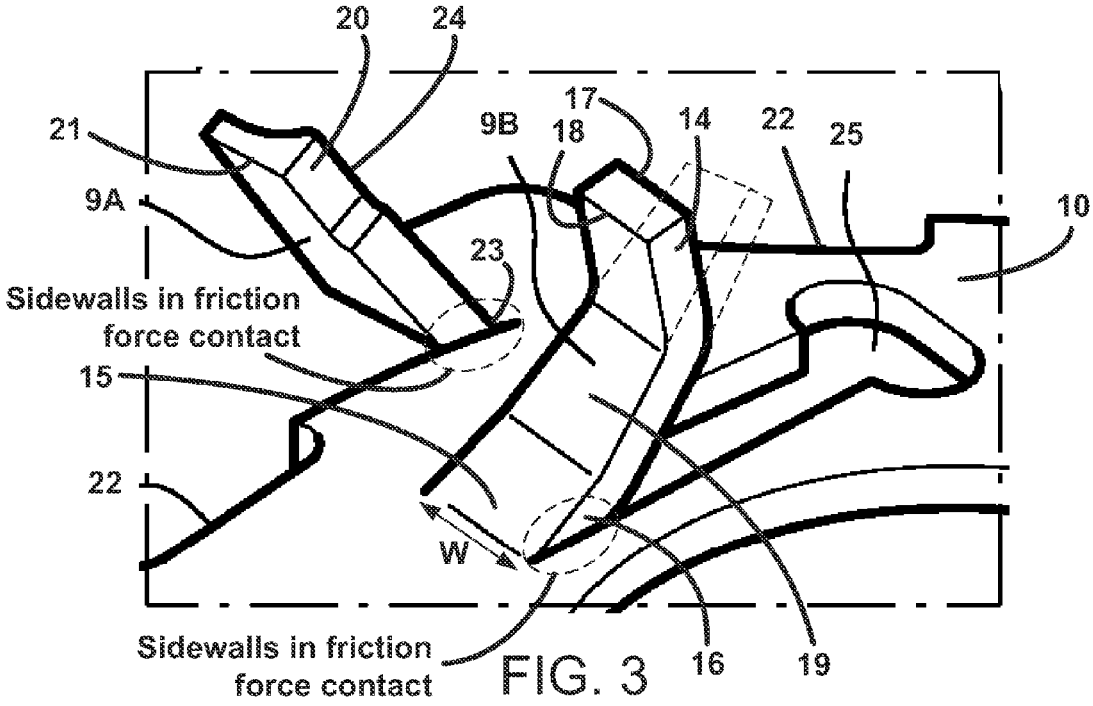
FIG. 3 shows a detail of the cutting member of FIG. 2.
Figure 4:
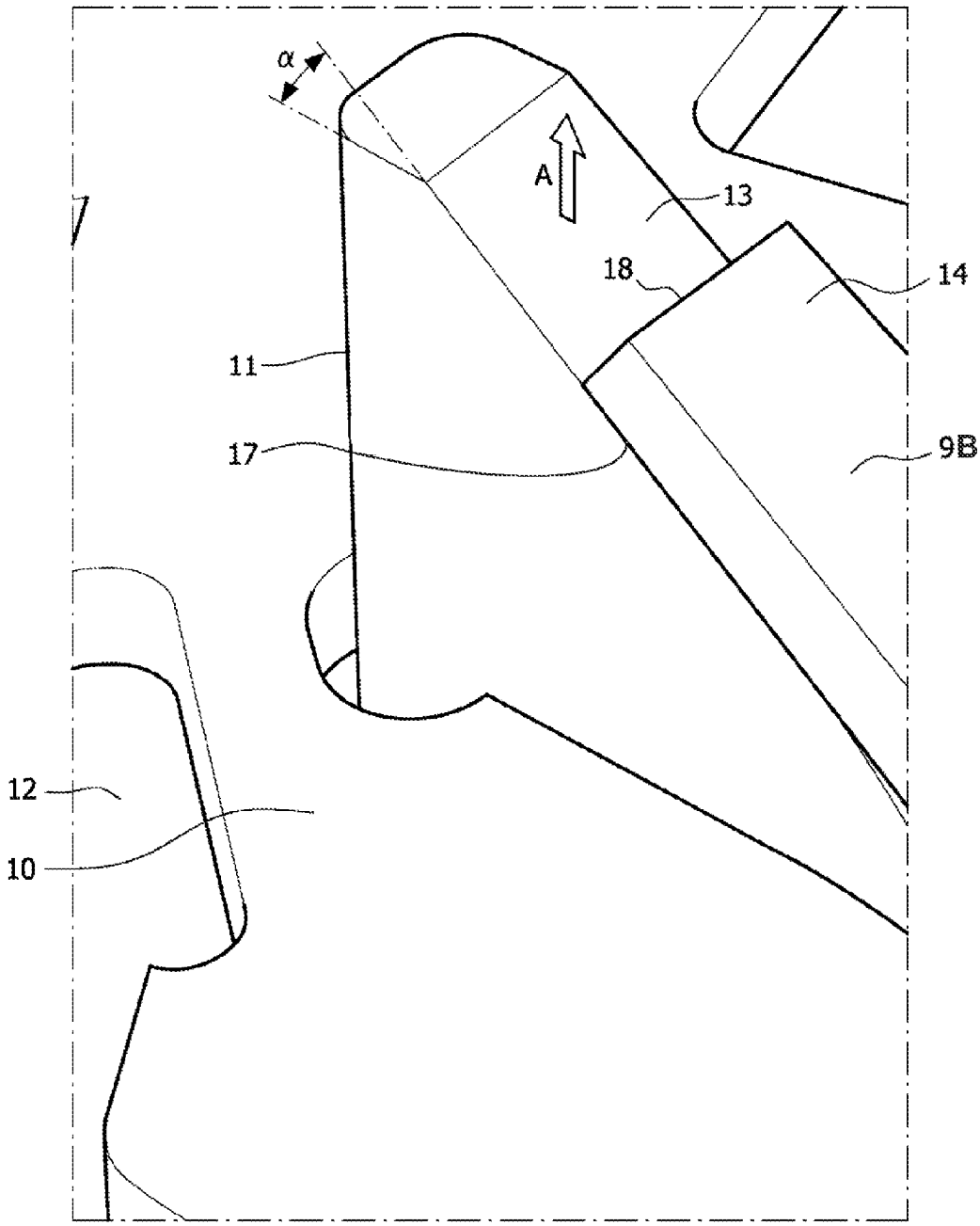
FIG. 4 schematically shows simultaneous steps of cutting free and bending in a method according to the invention.

The internal cutting member 6 is manufactured by a method according to the invention. According to the method, first a metal plate-shaped carrier 10 is provided. In the example shown in FIG. 2 the carrier 10 has a main angular shape. The cutting elements 9*a*, 9*b* are integrally formed with the carrier 10 by means of simultaneous steps of cutting free and bending which are schematically shown in FIG. 4 in connection with one of the cutting elements 9*b*. Said simultaneous steps are performed using a tool 11 having a combined punching and bending effect. During said simultaneous steps the carrier 10 is clamped between a first supporting surface 12 of a punching machine and a second supporting surface, which is not visible in FIG. 4 and is parallel to the first supporting surface 12. The tool 11 has a punching surface 13 that, during said simultaneous steps, has an angle of inclination $\alpha$ relative to the carrier 10. During said simultaneous steps the tool 11 is moved in an upward direction as indicated by the arrow A in FIG. 4. In this way the tool 11 will first hit an end portion 14 of the cutting element 9*b* to be formed. Said end portion 14 will be cut free from the carrier 10 by a tearing action and will simultaneously be bent upwardly into an inclined position relative to the carrier 10 corresponding with the angle of inclination $\alpha$. During the further movement of the tool 11 in the upward direction the punching surface 13 will tear free and bend successive portions of the cutting element 9*b* from said end portion 14 until a base 15 of the cutting element 9*b*, which is visible in FIG. 3. At that moment the motion of the tool 11 is stopped, so that near said base 15 a residual connection is maintained between the base 15 and the carrier 10. At this moment, the complete cutting element 9*b* has been cut free from the carrier 10, except for said residual connection, and bent upwardly relative to the carrier 10 into a bending angle relative to the carrier 10 corresponding with the angle of inclination $\alpha$. It is noted that, in order to improve the accuracy of the bending angle of the cutting element 9*b* and to prevent curling of the cutting element 9*b*, in the upward end position of the tool 11 the cutting element 9*b* is pressed by the tool 11 against an abutment surface, which is not visible in the figures and which has an identical angle of inclination $\alpha$.

Since with the method according to the invention the cutting element 9*b* is teared free from the carrier 10 by the tool 11, substantially no material is cut away from the carrier 10 and from the cutting element 9*b*. Accordingly the cutting member 6 manufactured according to said method will not show any substantial free space between the cutting element 9*b* and the carrier 10, viewed in directions parallel to the carrier 10. As substantially no material is cut away from the carrier 10, the mechanical strength of the carrier 10 is substantially not reduced by the method according to the invention. This implies that the dimensions of the carrier 10 need not be increased in order to compensate any loss of material during the manufacturing process. In the specific example shown in FIGS. 2 and 3 this advantage has been benefitted from in another manner, i.e. by providing the base 15 of the cutting element 9*b* with an increased width W relative to the remaining portion of the cutting element 9*b*. In this example the increased width W is possible because close to the base 15 the carrier 10 has more material left than close to a central region of the cutting element 9*b* due to the curved inner edge of the carrier 10. If a loss of material would have resulted from the manufacturing process, the possible increase of the width W of the base 15 would be much less. The increased width W provides the cutting element 9*b* with an increased stiffness and stability. As is visible in FIG. 3 the stiffness and stability of the cutting element 9*b* is further increased by the fact that, close to the residual connection between the base 15 and the carrier 10, the side walls 16 of the cutting element 9*b* are in contact with the carrier 10. This also is a direct consequence of the fact that substantially no free space is present between the cutting element 9*b* and the carrier 10, viewed in directions parallel to the carrier 10. As a result of said contact, friction forces are present between the carrier 10 and the portions of the side walls 16 in contact with the carrier 10. Said friction forces further increase the stiffness and stability of the cutting element 9*b*.

Figure 2:
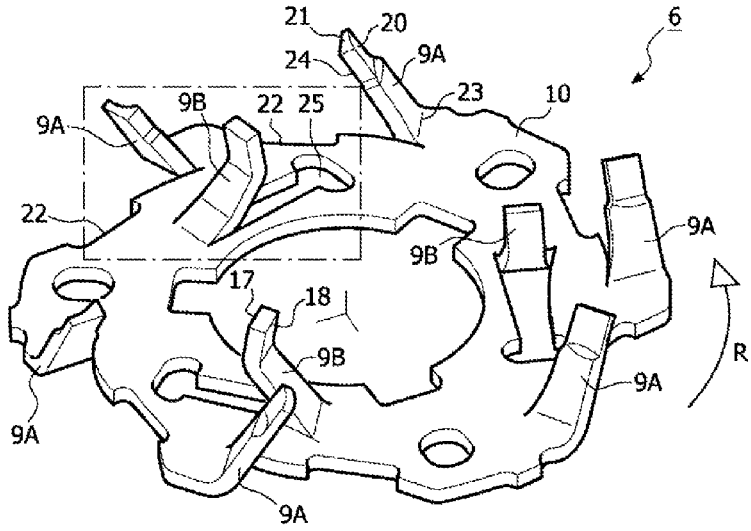
FIG. 2 shows a cutting member manufactured according to a method according to the invention.

During the process of cutting free the cutting element 9*b* by means of said tearing process, a lower edge 17 of the end portion 14 of the cutting element 9*b*, i.e. the edge that faces in a direction opposite to the upward direction A just before the cutting element 9*b* is bent (see FIGS. 3 and 4), is lastly teared free from the carrier 10. As a result said lower edge 17 will have a considerable degree of burrs caused by the tearing process, as contrasted with an upper edge 18 of the end portion 14 that is immediately teared free from the carrier 10 during the tearing process. If the position of the cutting element 9*b* after the simultaneous steps of cutting free and bending as shown in FIG. 4 would be the final position, said lower edge 17 would form the leading edge when viewed in the direction of rotation R of the cutting member 6 (see FIG. 2), so that said lower edge 17 would form the cutting edge of the cutting element 9*b*. This would require considerable after-processing efforts in order to remove the burrs from the lower edge 17. In order to prevent or limit such after-processing efforts, the simultaneous steps of cutting free and bending the cutting element 9*b* as schematically shown in FIG. 4 are followed by at least one additional step of bending at least a portion of the cutting element 9*b* into a final bent position as shown in FIGS. 2 and 3. In the particular example of the cutting element 9*b* a first additional bending step is performed to bend a central portion 19 of the cutting element 9*b* into a further inclined position relative to the base 15, and a second additional bending step is performed to bend the end portion 14 of the cutting element 9*b* into a further inclined position relative to the central portion 19. The additional bending steps are performed using common bending dies. In the final bent position of the cutting element 9*b* shown in FIGS. 2 and 3 the end portion 14 is bent over an angle greater than 90° relative to the carrier 10. The result is that the upper edge 18 forms the leading edge when viewed in the direction of rotation R of the cutting member 6, so that said upper edge 18 forms the cutting edge of the cutting element 9*b*. Since the upper edge 18 is relatively free from burrs, the cutting element 9*b* thus bent requires no or only limited after-processing in order to have a suitably sharp cutting edge.

The cutting elements 9*a* are formed by similar simultaneous steps of cutting free and bending from the carrier 10 as described before in connection with the cutting elements 9*b*. Also a number of additional steps of bending are performed in order to bend the cutting elements 9*a* in their final bent positions as shown in FIGS. 2 and 3. A difference with the cutting elements 9*b* is that, during the additional steps of bending, the cutting elements 9*b* are bent not partially but substantially entirely, while in their final bent positions the end portions 20 of the cutting elements 9*a* are bent over angles substantially smaller than 90° relative to the carrier 10. This implies that the lower edges 21 of said end portions 20 form the cutting edges of the cutting elements 9*a*. This is made possible because, before the simultaneous steps of cutting free and bending the cutting elements 9*a*, a free space is cut between the carrier 10 and the end portion 20 of each cutting element 9*a* by means of a suitable cutting die. In FIGS. 2 and 3 said free spaces are visible as recesses 22 in the circumferential edge of the carrier 10 and as recesses 24 in the end portions 20 of the cutting elements 9*a*. By cutting said free spaces around the end portions 20, the edges of said end portions 20 and particularly also the lower edges 21, that form the cutting edges, remain free from burrs. In the following simultaneous steps of cutting free and bending, the remaining portions of the cutting elements 9*a* between the end portion 20 and the base 23 are teared free from the carrier 10, so that at these locations no free spaces between the cutting elements 9*a* and the carrier 10 arise. As a result, the reduction of the strength of the carrier 10 by the free spaces is limited to the area immediately around the end portions 20.

It is noted that the holes 25 provided in the carrier 10 near the end portions 14 of the cutting elements 9*b* do not constitute free spaces within the meaning described above. The holes 25 do not surround the end portions 14, but only adjoin the end faces of the end portions 14. The holes 25 are provided to facilitate the initialization of the tearing process performed by the tool 11.

The invention claimed is:

1. A method of manufacturing a cutting member of a shaver, comprising the steps of:

providing a plate-shaped carrier with at least one hole in the carrier that adjoins an end face of a cutting edge end portion of at least one cutting element yet to be formed;

cutting, via tearing, at least one cutting element free from the carrier except for a residual connection between a base of the cutting element and the carrier; and bending the cutting element relative to the carrier, wherein the steps of cutting free and bending the cutting element are performed simultaneously using a tool having a punching surface that produces a combined punching and bending effect, wherein the at least one hole in the carrier facilitates initialization of the cutting, via tearing, performed by the tool, and wherein the cutting element is teared free along sidewalls of the cutting element and simultaneously bent out of the carrier, wherein portions of the sidewalls of the at least one cutting element close to the residual connection are in friction force contact with corresponding sidewalls of the carrier close to the residual connection, and wherein, in the area of the portions of the sidewalls in friction force contact close to the residual connection, there is no free space present between the sidewalls of the cutting element and corresponding sidewalls of the carrier that are in friction force contact with each other.

2. The method as claimed in claim 1, wherein the punching surface has an angle of inclination relative to the carrier substantially corresponding with a desired bending angle of the cutting element relative to the carrier.

3. The method as claimed in claim 1, wherein the simultaneous steps of cutting free and bending the cutting element are followed by at least one additional step of bending, via common bending dies, at least a portion of the cutting element into a final bent position.

4. The method as claimed in claim 3, wherein in the final bent position at least an end portion of the cutting element carrying a cutting edge is bent over an angle greater than 90° relative to the carrier.

5. The method as claimed in claim 1, wherein before the simultaneous steps of cutting free and bending the cutting element, a free space that corresponds to (i) an opening in the plate-shaped carrier or (ii) a recess in a side of the plate-shaped carrier is cut, via suitable cutting dies, between (a) the plate-shaped carrier and (b) a cutting edge end portion of a yet to be formed cutting element.

6. A cutting unit comprising an external cutting member and an internal cutting member movable relative to the external cutting member, wherein the internal cutting member comprises a plate-shaped carrier; and at least one cutting element, wherein the at least one cutting element is bent relative to the plate-shaped carrier in response to the at least one cutting element being cut free via a simultaneously tearing and bending cut along sidewalls of the cutting element from the plate-shaped carrier except for a residual connection, wherein an initialization of the tearing and bending cut was facilitated by at least one hole in the plate-shaped carrier that adjoined an end face of a cutting edge end portion of the at least one cutting element, the residual connection being between a base of the cutting element and the plate-shaped carrier, and further wherein portions of the sidewalls of the at least one cutting element close to the residual connection are in friction force contact with corresponding sidewalls of the carrier close to the residual connection, and there is no free space present between the portions of the sidewalls of the cutting element and corresponding sidewalls of the carrier that are in friction force contact with each other close to the residual connection.

7. A shaving unit comprising at least one cutting unit as claimed in claim 6.

8. A shaver comprising a shaving unit as claimed in claim 7.

* * * * *